US007455042B2

(12) United States Patent
Jacobi-Hinderer

(10) Patent No.: US 7,455,042 B2
(45) Date of Patent: Nov. 25, 2008

(54) SUCTION SYSTEM WITH A DEVICE FOR AVOIDING THE INGRESS OF WATER

(75) Inventor: Heiko Jacobi-Hinderer, Remseck (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 11/697,461

(22) Filed: Apr. 6, 2007

(65) Prior Publication Data

US 2007/0235000 A1 Oct. 11, 2007

(30) Foreign Application Priority Data

Apr. 7, 2006 (DE) ..... 10 2006 016 433

(51) Int. Cl.
*F02M 35/02* (2006.01)
*F02M 35/10* (2006.01)

(52) U.S. Cl. ..... 123/198 E; 123/184.21

(58) Field of Classification Search ..... 123/198 E, 123/184.21, 198 D; 181/229; 55/385.3
See application file for complete search history.

(56) References Cited

U.S. PATENT DOCUMENTS 6,453,866 B1 * 9/2002 Altmann et al. ..... 123/184.21
6,510,832 B2 1/2003 Maurer et al.
6,564,768 B2 * 5/2003 Bauer et al. ..... 123/198 E
6,705,272 B2 * 3/2004 Leipelt et al. ..... 123/198 E
6,761,748 B2 * 7/2004 Schenk et al. ..... 55/385.3

FOREIGN PATENT DOCUMENTS

DE 37 36 777 C1 12/1988
DE 100 53 146 A1 5/2002

OTHER PUBLICATIONS

German Office Action dated Dec. 18, 2006, including English translation (Seven (7) pages).

* cited by examiner

*Primary Examiner*—Stephen K. Cronin
*Assistant Examiner*—Hyder Ali
(74) *Attorney, Agent, or Firm*—Crowell & Moring LLP

(57) ABSTRACT

A suction system for an internal combustion engine has a device for avoiding the ingress of water and includes a switch-over valve between a primary intake line and a secondary intake line. To provide improved protection against water ingress, the switch-over valve is controlled so that during off-road travel there is a change-over from a primary air intake to a secondary air intake.

2 Claims, 1 Drawing Sheet

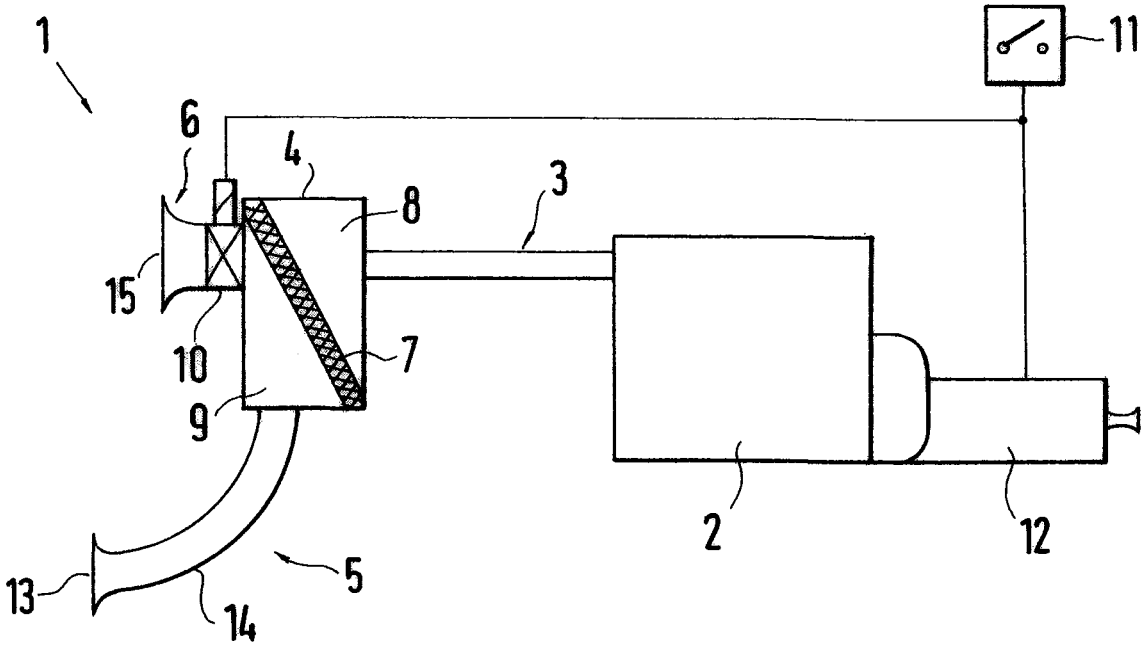
1
6
4
8
3
11
15
10
7
9
2
12
13
14
5

SUCTION SYSTEM WITH A DEVICE FOR AVOIDING THE INGRESS OF WATER

RELATED APPLICATIONS

This application claims the benefit of priority under 35 U.S.C. § 119, to German Patent Application No. 10 2006 016 433.4, filed Apr. 7, 2006, the disclosure of which is incorporated by reference herein in its entirety.

BACKGROUND AND SUMMARY OF THE INVENTION

The present invention relates to a suction system for an internal combustion engine with a device for avoiding the ingress of water.

In general, the ingress of water via a suction system is undesired in internal combustion engines. Because the internal combustion engine is supposed to be supplied with outside air, however, there is always the risk that water will reach the intake port. Of course, intake of air from the engine compartment significantly reduces the risk of an ingress of water, but leads simultaneously to a higher air temperature in the engine compartment. This has the drawback of a decrease in the performance of the internal combustion engine performance, an effect that is very disturbing at high driving speeds.

DE 37 36 777 C1 has already disclosed a device for avoiding the ingress of water into an air filter housing, disposed in a fresh air intake line in an internal combustion engine. In this device the ingress of water is detected by a water sensor in the fresh air intake line. A control unit reverses a switch-over valve disposed downstream of the water sensor in the fresh air intake line. Thereby, at this stage the internal combustion engine is connected to an engine compartment intake line. As soon as the water sensor no longer perceives any water, the switch-over valve is reset, and in so doing the internal combustion engine is supplied from the fresh air intake line. For this known device to function, however, water must have already penetrated into the intake line, so that the intake path may be switched over, and the internal combustion engine is protected against the ingress of water.

An object of the invention is to provide a suction system with improved protection against the ingress of water. This protection shall be effective even if, for example, the fresh air intake line is totally covered with water, as is possible, for example, when wading through a body of water.

This object has been achieved by actuating a switch-over valve during off-road travel. That is, the switch-over valve is controlled so that, during off-road travel, a change-over occurs from a primary air intake to a secondary air intake.

According to the present invention, off-road travel is detected when a switch that is provided for operating the transmission is actuated for selecting an off-road reduction group. As an alternative (or in addition), the position of a switch may also be used to increase the ground clearance of the vehicle.

The primary intake line is preferably a fresh air intake line, i.e., an intake line, whose intake port is located outside of the vehicle. The secondary intake line is preferably configured as an engine compartment intake line whose intake port is located in a water-protected spot and in a manner that it lies as high geodetically as possible. It may, for example, be an intake line in the engine compartment. In that case, this intake port must take in air that is as cool as possible. Other locations of the intake port are also contemplated, however, such as a snorkel projecting beyond the vehicle, as long as locations are protected against the ingress of water.

Other objects, advantages and novel features of the present invention will become apparent from the following detailed description of the invention when considered in conjunction with the accompanying drawings.

BRIEF DESCRIPTION OF THE DRAWING

FIG. 1 is a schematic view of an engine suction system in according to the present invention.

DETAILED DESCRIPTION OF THE DRAWING

A suction system designated generally by numeral 1, guides air to an internal combustion engine 2. The suction system 1 comprises a cleaned air line 3, connecting the internal combustion engine 2 to an air filter 4, as well as a primary intake line 5, and a secondary intake line 6. An air filter 7 is arranged inside the air filter housing 4 and delimits a cleaned air side 8 from an uncleaned air side 9 inside the air filter housing 4.

Both the primary intake line 5 and the secondary intake line 6 are connected to the uncleaned air side 9.

The secondary intake line 6 can be closed in its admission area into the air filter housing 4 by an electromagnetically operated valve 10. The valve 10 is actuated by the signal of a switch 11 which is provided for connecting an off-road reduction group to a transmission 12, connected to the internal combustion engine 2. This off-road reduction group is characterized in particular by very high reductions and, thus, low driving speeds and is, therefore, not used during normal road travel.

With an actuated switch 11 and, thus, an engaged off-road reduction group in the transmission 12, the valve 10 is opened. The primary intake line 5 and the secondary intake line 6 are adjusted in relation to each other in such a manner that the flow resistance in the secondary intake line 6 is significantly less. Therefore, when the valve 10 is opened, the only intake of air into the air filter housing 4 is in essence through the secondary intake line 6. In any event, however, the flow rate into the primary intake line 5 is reduced to the extent that the intake current no longer drags any water particles with it, and in no case is there any intake of water through the primary intake line 5.

In the illustrated embodiment, the primary intake line 5 is a fresh air intake line whose intake port 13 is located in the front, bottom nose area of a vehicle. The intake port 13 lies geodetically deeper than the air filter housing 4. A pipe 14 that connects the intake port 13 to the air filter housing 4 is comparatively long and bent off.

In contrast, the secondary intake line 6 is only a few centimeters long, so that a second intake port 15 is located directly in front of the air filter housing 4. Thus, the intake port 15 is disposed, as is also the air filter housing 4, in the vehicle engine compartment.

The invention claimed is:

1. Suction system for avoiding the ingress of water, comprising a switch-over valve between a primary intake line and a secondary intake line, the switch-over valve being actuated upon occurrence of off-road travel wherein, to detect off-road travel, a switch is operative to select an off-road reduction group in a transmission.

2. Suction system as claimed in claim 1, wherein the primary intake line is a fresh air intake line, and the secondary intake line is an engine compartment intake line.

* * * * *